US010168010B1

(12) United States Patent
Hsu

(10) Patent No.: US 10,168,010 B1
(45) Date of Patent: Jan. 1, 2019

(54) GROUND INSERT GARDEN LAMP

(71) Applicant: Dong Guan Jia Sheng Lighting Technology Co., Ltd. China, Dong-Guna, Guang-Dong (CN)

(72) Inventor: Kevin Hsu, Taichung (TW)

(73) Assignee: Dong Guan Jia Sheng Lighting Technology Co., Ltd. China, Guang Dong (CN)

( * ) Notice: Subject to any disclaimer, the term of this patent is extended or adjusted under 35 U.S.C. 154(b) by 0 days.

(21) Appl. No.: 15/697,506

(22) Filed: Sep. 7, 2017

(51) Int. Cl.
*F21S 6/00* (2006.01)
*F21V 21/02* (2006.01)
*F21W 131/109* (2006.01)

(52) U.S. Cl.
CPC ..... *F21S 6/005* (2013.01); *F21V 21/02* (2013.01); *F21W 2131/109* (2013.01)

(58) Field of Classification Search
CPC .... F21S 6/00; F21S 6/005; F21S 6/006; F21S 6/008; F21S 8/03; F21S 8/032; F21S 8/033; F21S 8/036; F21S 8/043; F21S 8/081; F21S 8/083; F21S 8/085; F21S 9/032; F21S 9/035; F21S 9/037; F21V 21/02; F21V 21/116; F21V 21/12; F21V 21/0824; F21W 2131/109
See application file for complete search history.

(56) References Cited

U.S. PATENT DOCUMENTS 6,328,457 B1 * 12/2001 Huang ..... F21S 8/06 362/363
7,708,433 B2 * 5/2010 Korn ..... F21S 8/032 362/431
2016/0161097 A1 * 6/2016 Xu ..... F21V 21/0824 362/382
2018/0073709 A1 * 3/2018 Enck, Sr. ..... F21V 21/116

* cited by examiner

*Primary Examiner* — Y. M. Lee
(74) *Attorney, Agent, or Firm* — Alan D. Kamrath; Kamrath IP Lawfirm, P.A.

(57) ABSTRACT

A ground insert lamp includes a fixed seat, a stake, a lamp body and a plurality of fasteners. The fixed seat includes a pedal and a connector integrally formed on the pedal. The connector has a periphery provided with a breach. The lamp body is removably mounted on the connector. The pedal has a periphery provided with an opening connected to the breach of the connector. The pedal has an upper face provided with a plurality of ribs. The pedal is provided with a slot corresponding to the stake and a plurality of fastening holes corresponding to the fasteners. The fixed seat is affixed to the ground by the stake or affixed to the wall by the fasteners.

8 Claims, 15 Drawing Sheets

GROUND INSERT GARDEN LAMP

BACKGROUND OF THE INVENTION

1. Field of the Invention

The present invention relates to a lamp fixture and, more particularly, to a ground insert garden lamp.

2. Description of the Related Art

A conventional garden lamp comprises an upright post, a lamp body mounted on the upper end of the upright post, and a stake mounted on the lower end of the upright post. When a downward force is applied on the lamp body, the stake is inserted into the ground to mount the garden lamp on the ground. However, the downward force is directly applied on the lamp body, so that the lamp body is easily worn out or broken. In addition, the garden lamp is easily loosened or tilts after mounting. Further, the garden lamp is only mounted on the ground and cannot be mounted to a wall.

BRIEF SUMMARY OF THE INVENTION

In accordance with the present invention, there is provided a ground insert lamp comprising a fixed seat, a stake, a lamp body and a plurality of fasteners. The fixed seat is affixed to a ground by the stake or affixed to a wall by the fasteners. The fixed seat includes a pedal and a connector integrally formed on the pedal. The connector has a periphery provided with a breach extending longitudinally. The lamp body is removably mounted on the connector. The pedal has a periphery provided with an opening extending inwardly and connected to the breach of the connector. The pedal has an upper face provided with a plurality of ribs. The pedal is provided with a slot corresponding to the stake and a plurality of fastening holes corresponding to the fasteners.

According to the primary advantage of the present invention, the fixed seat is affixed to the ground by the stake or affixed to the wall by the fasteners, so that the ground insert lamp is attached to the ground or the wall according to the user's requirement, thereby enhancing the versatility of the ground insert lamp.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
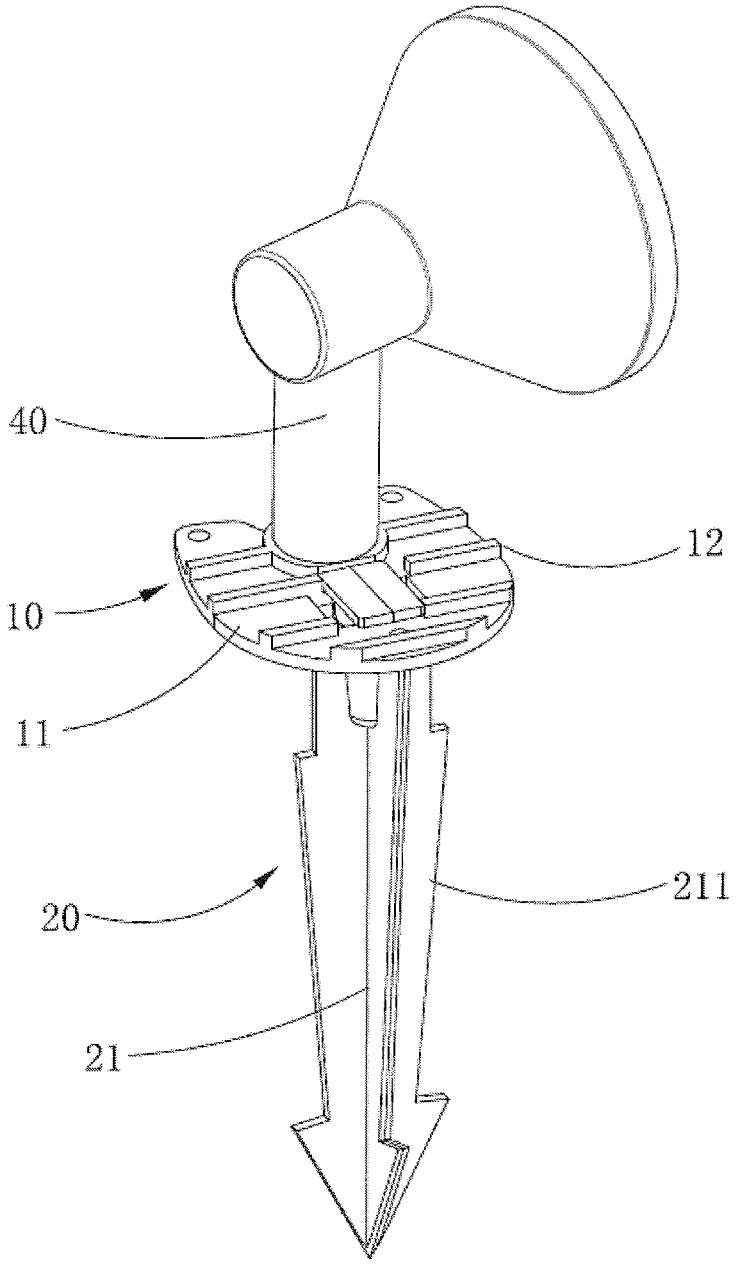
FIG. 1 is a perspective view of a ground insert lamp in accordance with the first preferred embodiment of the present invention.

Referring to the drawings and initially to FIGS. 1-5, a ground insert lamp in accordance with the preferred embodiment of the present invention comprises a fixed seat 10, a stake 20, a lamp body 40 and a plurality of fasteners 30.

Figure 4:
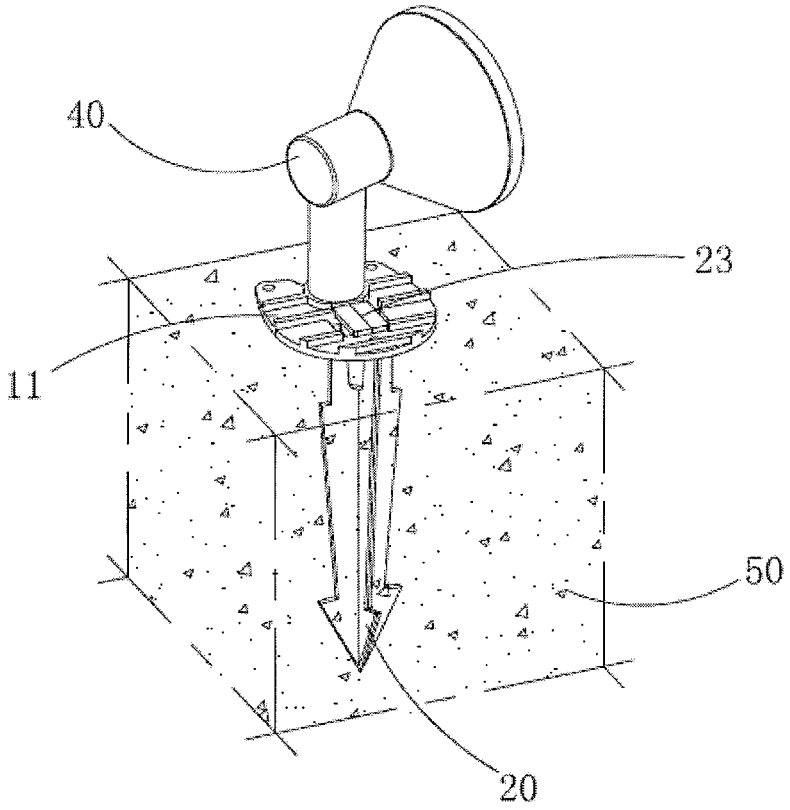
FIG. 4 is a perspective view showing the ground insert lamp being mounted on the ground.
Figure 5:
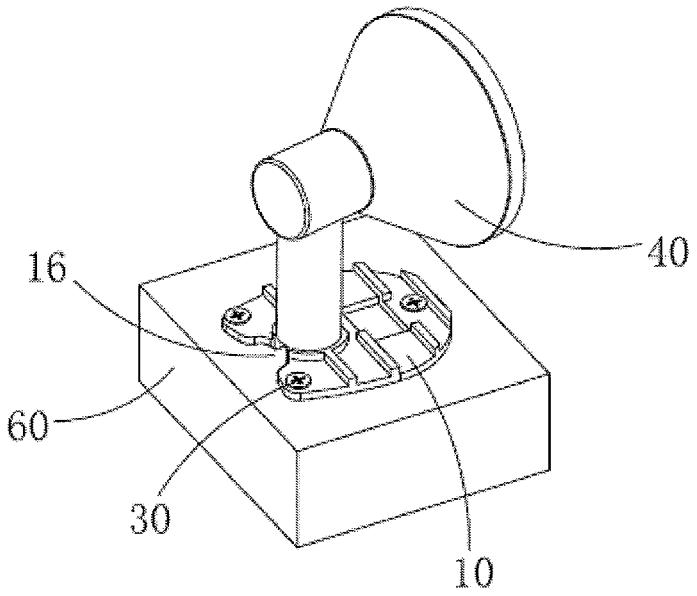
FIG. 5 is a perspective view showing the ground insert lamp being mounted on the wall.

The fixed seat 10 is affixed to a ground 50 by the stake 20 as shown in FIG. 4 or affixed to a wall 60 by the fasteners 30 as shown in FIG. 5. The fixed seat 10 includes a pedal 11 and a connector 13 integrally formed on the pedal 11. The connector 13 has an annular shape and has a periphery provided with a breach 16 extending longitudinally. The lamp body 40 is removably mounted on the connector 13. Preferably, the lamp body 40 has an internal thread screwed onto an external thread of the connector 13. The pedal 11 has a periphery provided with an opening 17 extending inwardly and connected to the breach 16 of the connector 13. The pedal 11 has an upper face provided with a plurality of ribs 12. The pedal 11 is provided with a slot 14 corresponding to the stake 20 and a plurality of fastening holes 15 corresponding to the fasteners 30.

In the preferred embodiment of the present invention, the stake 20 includes an insert 21 and a restriction member 23 mounted on an upper end of the insert 21. The insert 21 includes a plurality of upright plates 211 arranged in a radiating manner. Each of the upright plates 211 has a bottom having a tapered shape, with a vertical distance between an outer edge of the bottom of each of the upright plates 211 and a central axis of the insert 21 increasing gradually from bottom to top. Thus, the insert 21 has a conic pointed bottom that is inserted into the earth easily.

In the preferred embodiment of the present invention, the stake 20 further includes a connecting portion 22 located between the insert 21 and the restriction member 23. The restriction member 23 of the stake 20 has a sheet shape. Preferably, the restriction member 23 of the stake 20 and the slot 14 of the pedal 11 have a rectangular shape. The restriction member 23 of the stake 20 is inserted through the slot 14 of the pedal 11 and extends through the pedal 11 from bottom to top. Each of the upright plates 211 has a top resting on a bottom of the pedal 11.

In the preferred embodiment of the present invention, the ribs 12 are divided into multiple pairs corresponding to and aligning with each other. The slot 14 of the pedal 11 is arranged between four ribs 12, with two diagonal ribs 12 extending into two sides of the slot 14, so that the four ribs 12 surround the slot 14 of the pedal 11 and form a space which allows a oneway rotation of the restriction member 23 of the stake 20. In assembly, the stake 20 is rotatable relative to the pedal 11, with the restriction member 23 of the stake 20 being locked between two pairs of ribs 12.

Figure 2:
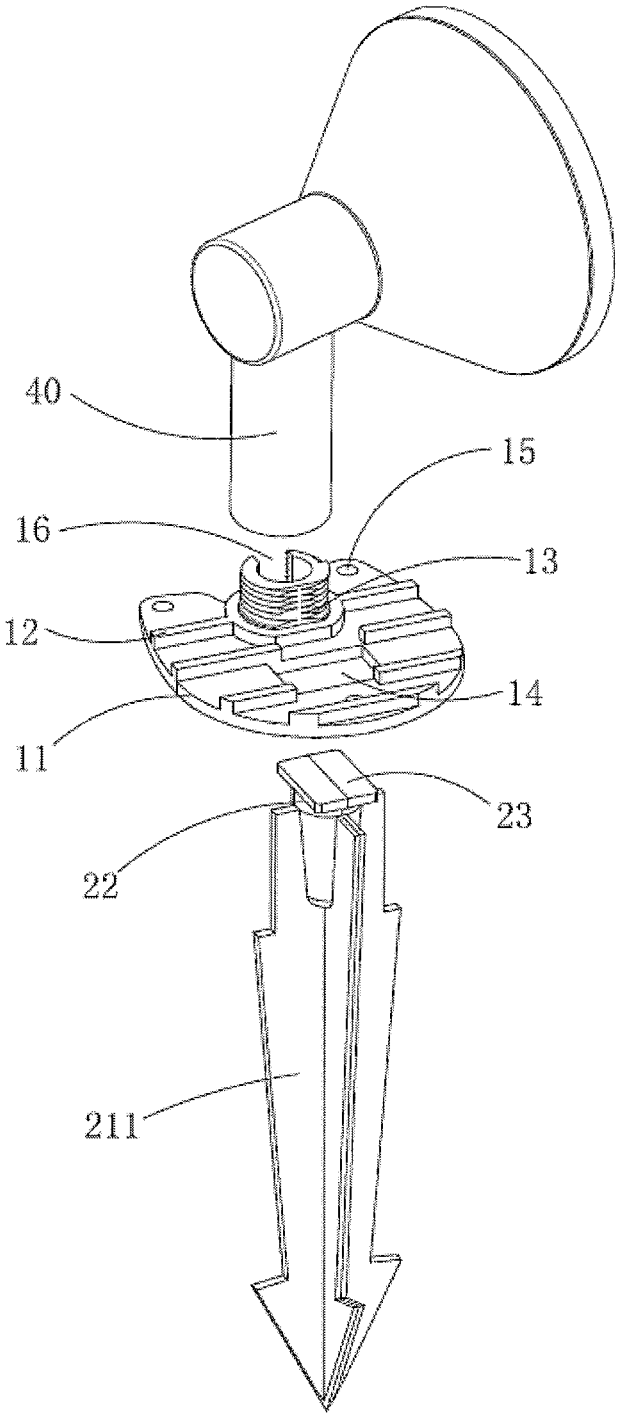
FIG. 2 is an exploded perspective view of the ground insert lamp as shown in FIG. 1.
Figure 3:
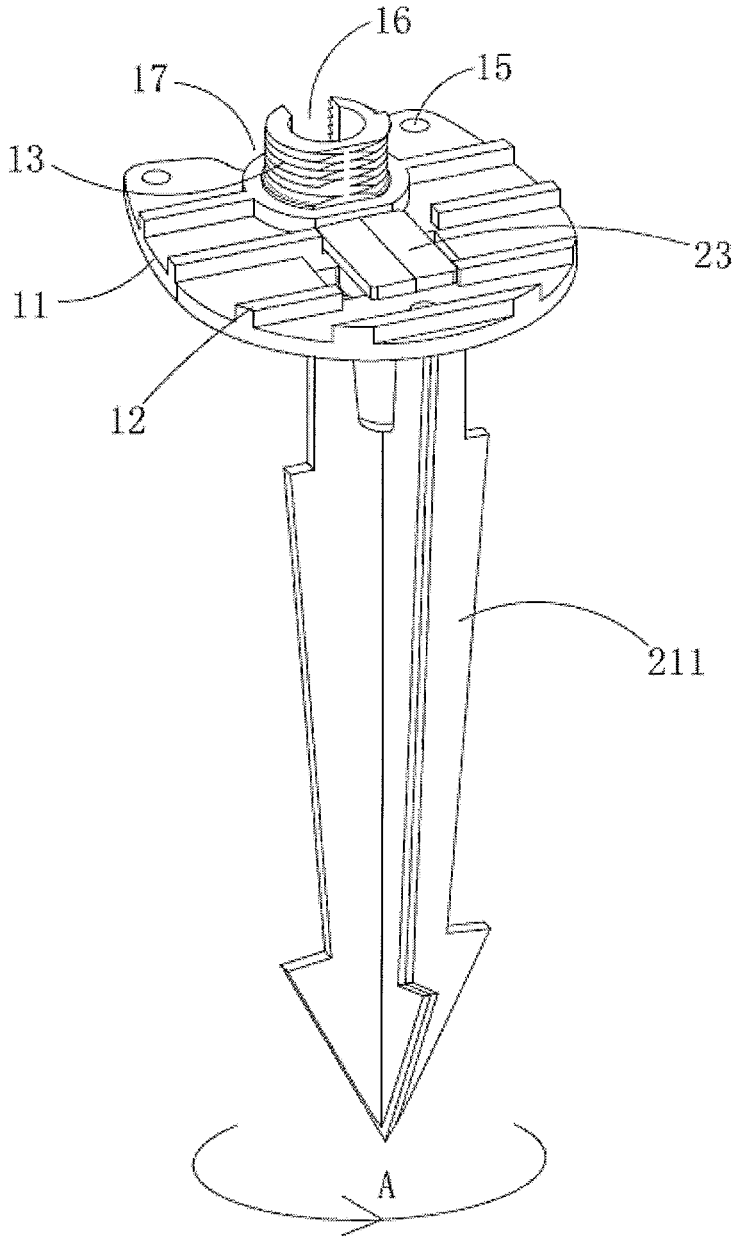
FIG. 3 is a schematic operational view of the ground insert lamp as shown in FIG. 1 in assembly.

In operation, referring to FIG. 4 with reference to FIGS. 1-3, the restriction member 23 of the stake 20 corresponds to the slot 14 of the pedal 11, with longer and shorter sides of the restriction member 23 respectively aligning with longer and shorter sides of the slot 14. Then, the restriction member 23 of the stake 20 is inserted through the slot 14 of the pedal 11 from bottom to top and is disposed above the pedal 11. Then, the stake 20 is rotated relative to the fixed seat 10 in the direction as indicated by the arrow "A" shown in FIG. 3, so that the restriction member 23 of the stake 20 is locked between two pairs of ribs 12, and the stake 20 is attached to the fixed seat 10. The pedal 11 is treaded by the user so that the stake 20 is inserted into the ground 50 as shown in FIG. 4, and the fixed seat 10 is affixed to the ground 50. Alternatively, referring to FIG. 5 with reference to FIGS. 1-3, the stake 20 is removed from the fixed seat 10, and the fasteners 30 extend through the fastening holes 15 of the pedal 11 and are inserted into the wall 60, so that the fixed seat 10 is directly affixed to the wall 60 by the fasteners 30 as shown in FIG. 5.

Accordingly, the fixed seat 10 is affixed to the ground 50 by the stake 20 or affixed to the wall 60 by the fasteners 30, so that the ground insert lamp is attached to the ground 50 or the wall 60 according to the user's requirement, thereby enhancing the versatility of the ground insert lamp.

Figure 6:
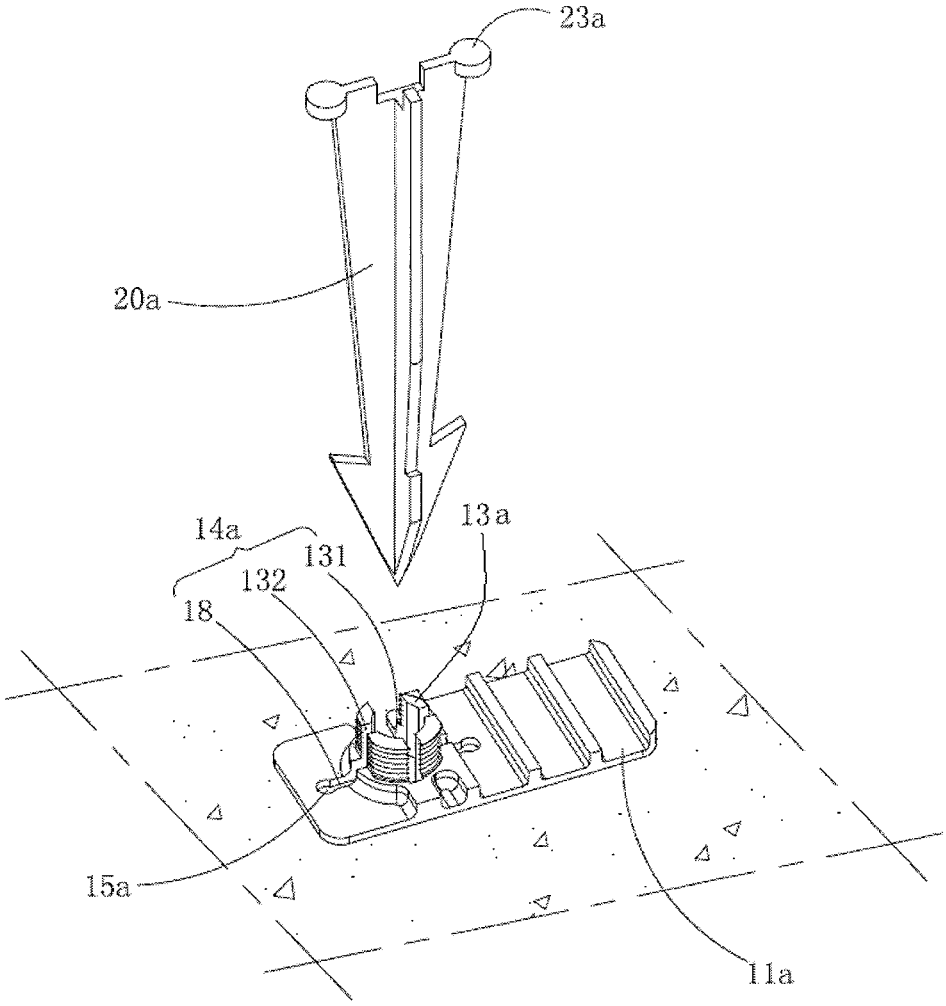
FIG. 6 is a partially exploded perspective assembly view of a ground insert lamp in accordance with the second preferred embodiment of the present invention.
Figure 7:
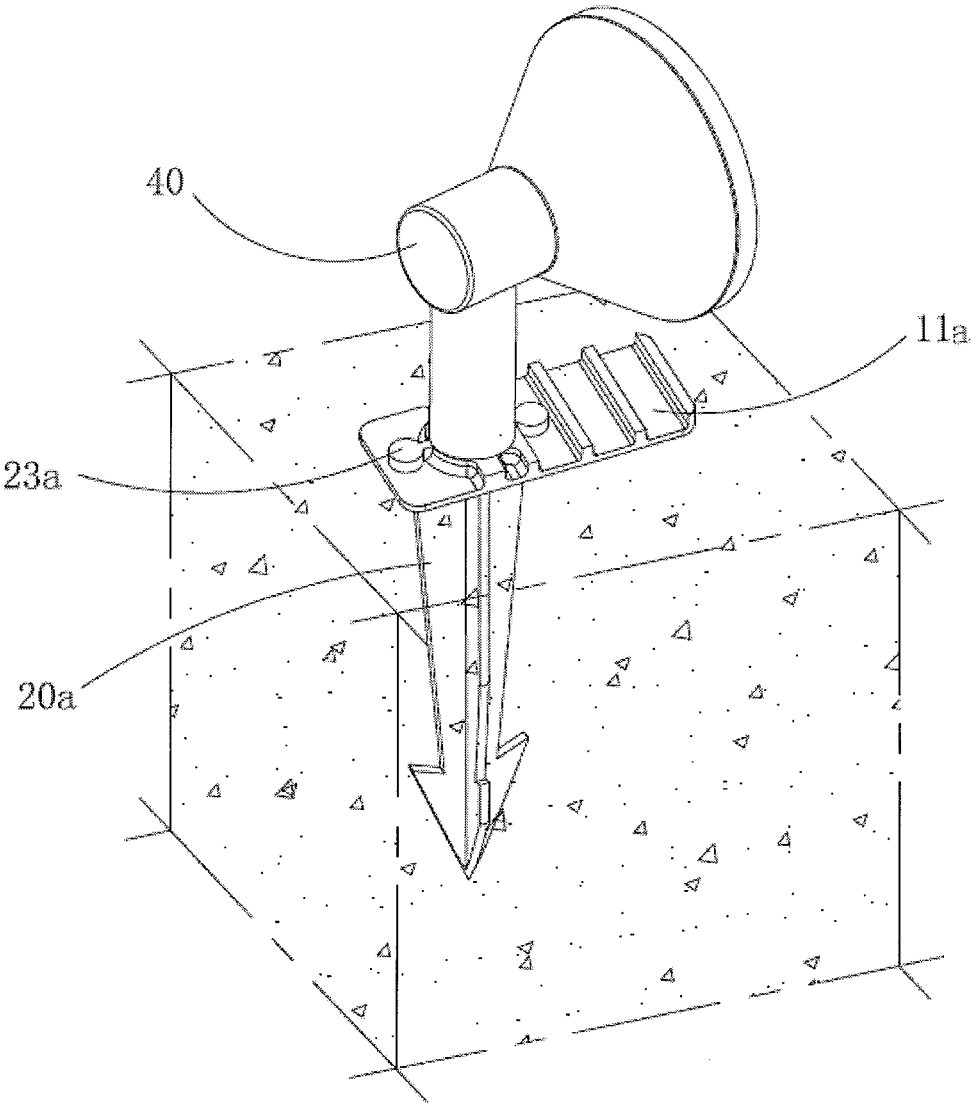
FIG. 7 is a perspective view showing the ground insert lamp being mounted on the ground.
Figure 8:
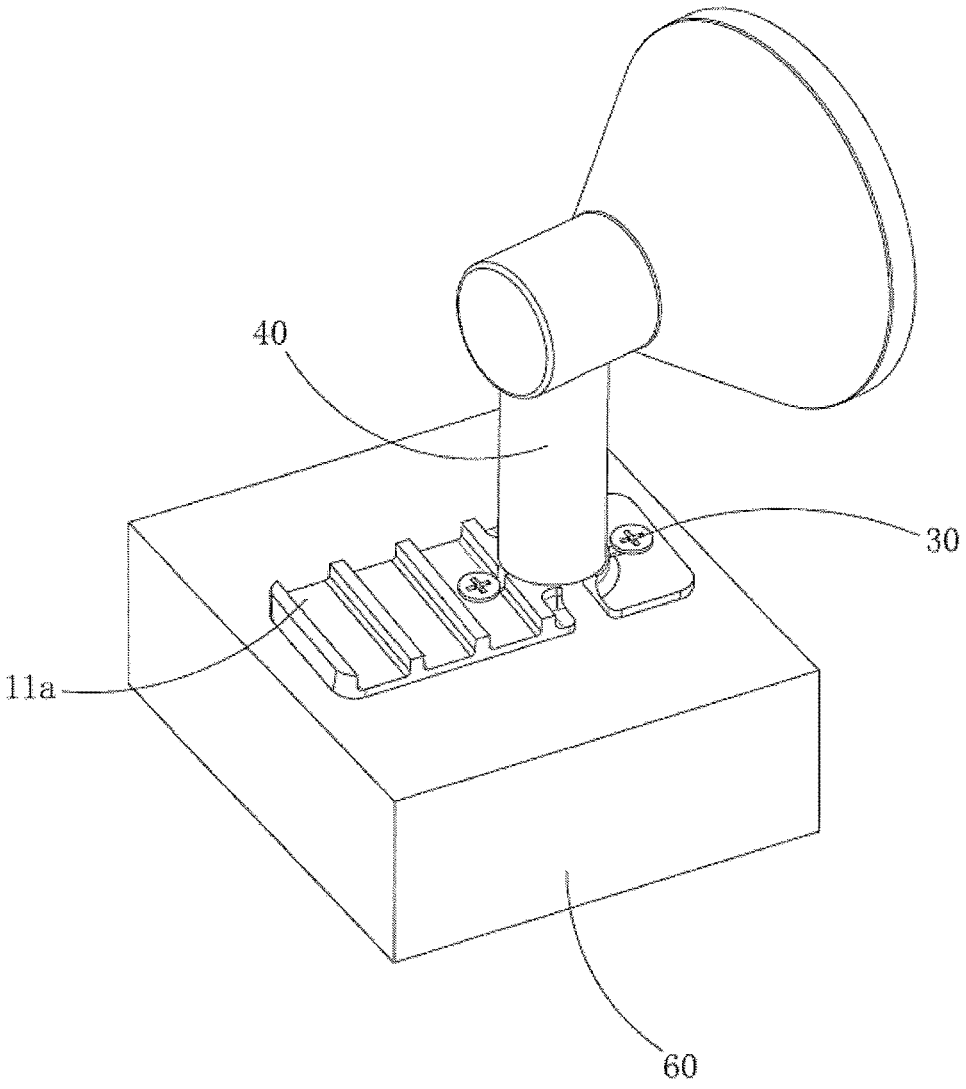
FIG. 8 is a perspective view showing the ground insert lamp being mounted on the wall.
Figure 9:
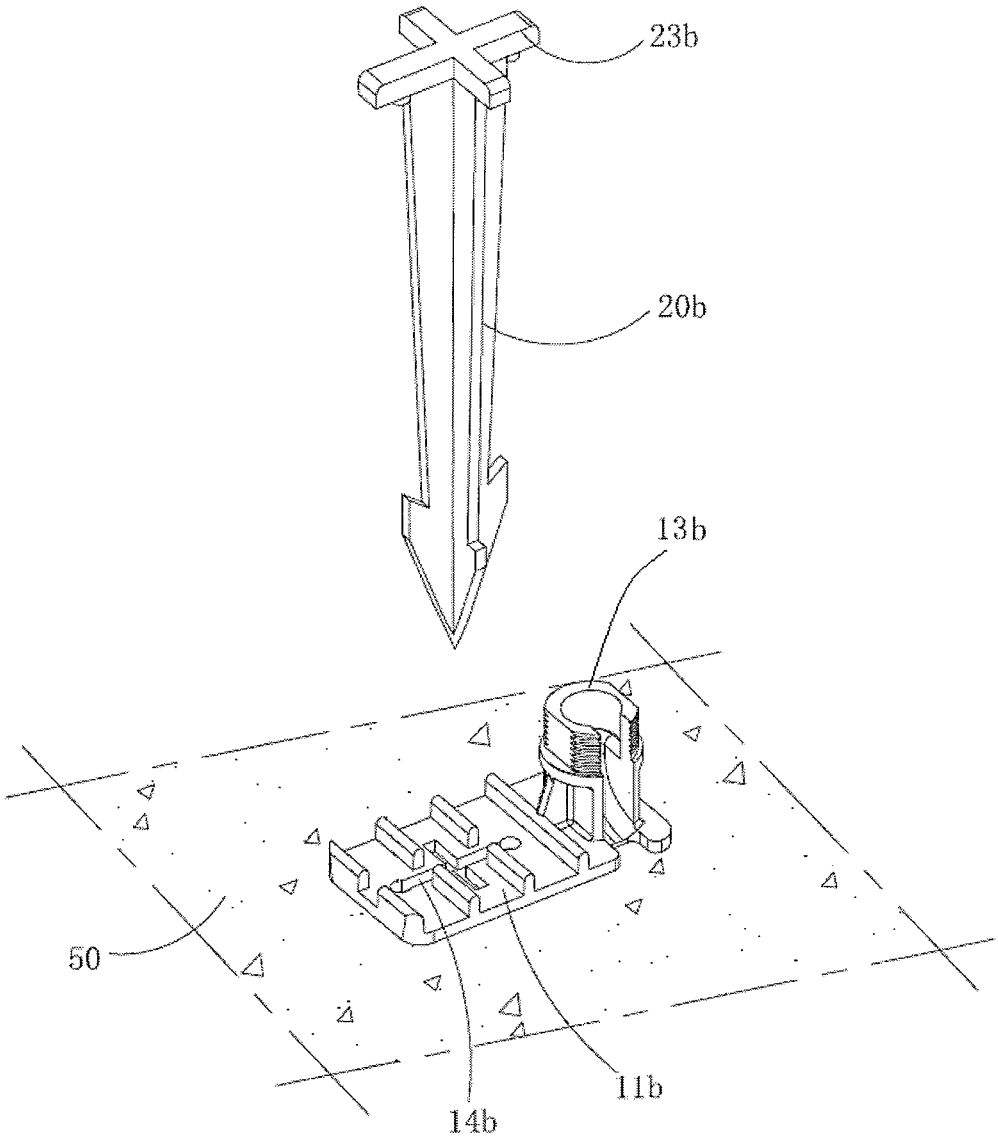
FIG. 9 is a partially exploded perspective assembly view of a ground insert lamp in accordance with the third preferred embodiment of the present invention.
Figure 10:
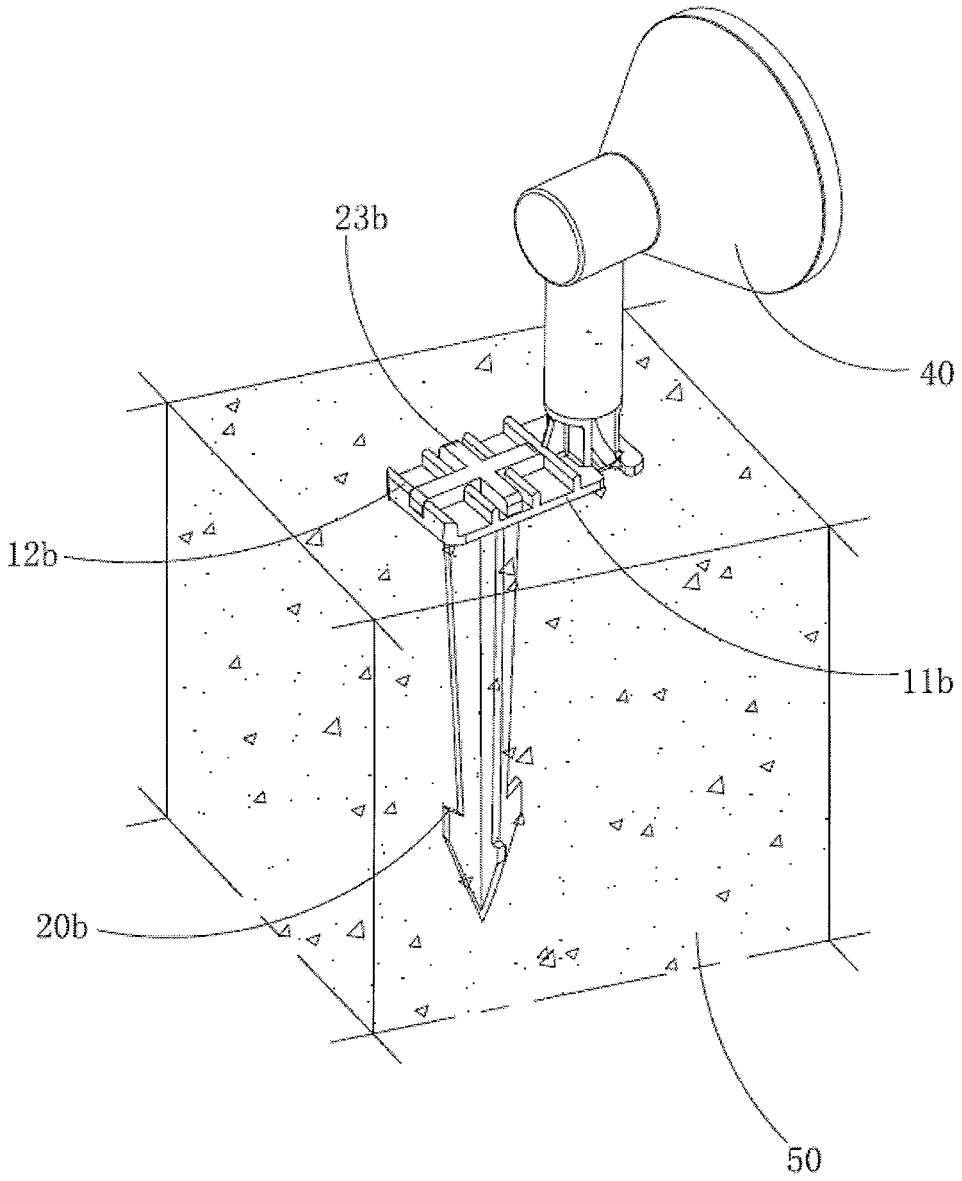
FIG. 10 is a perspective view showing the ground insert lamp being mounted on the ground.
Figure 11:
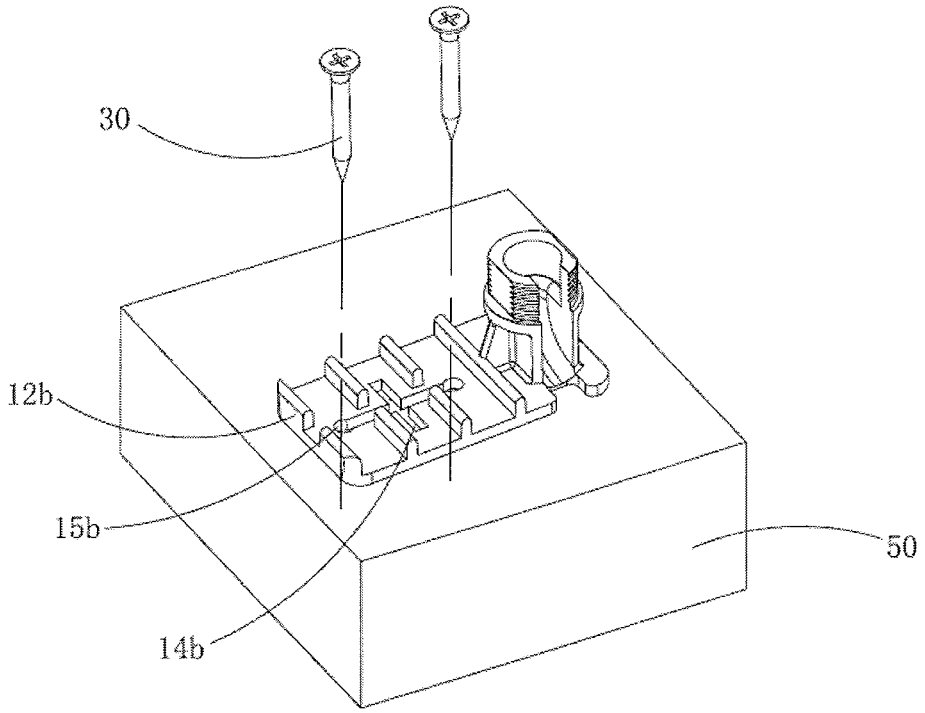
FIG. 11 is a perspective operational view showing the ground insert lamp being mounted on the wall.
Figure 12:
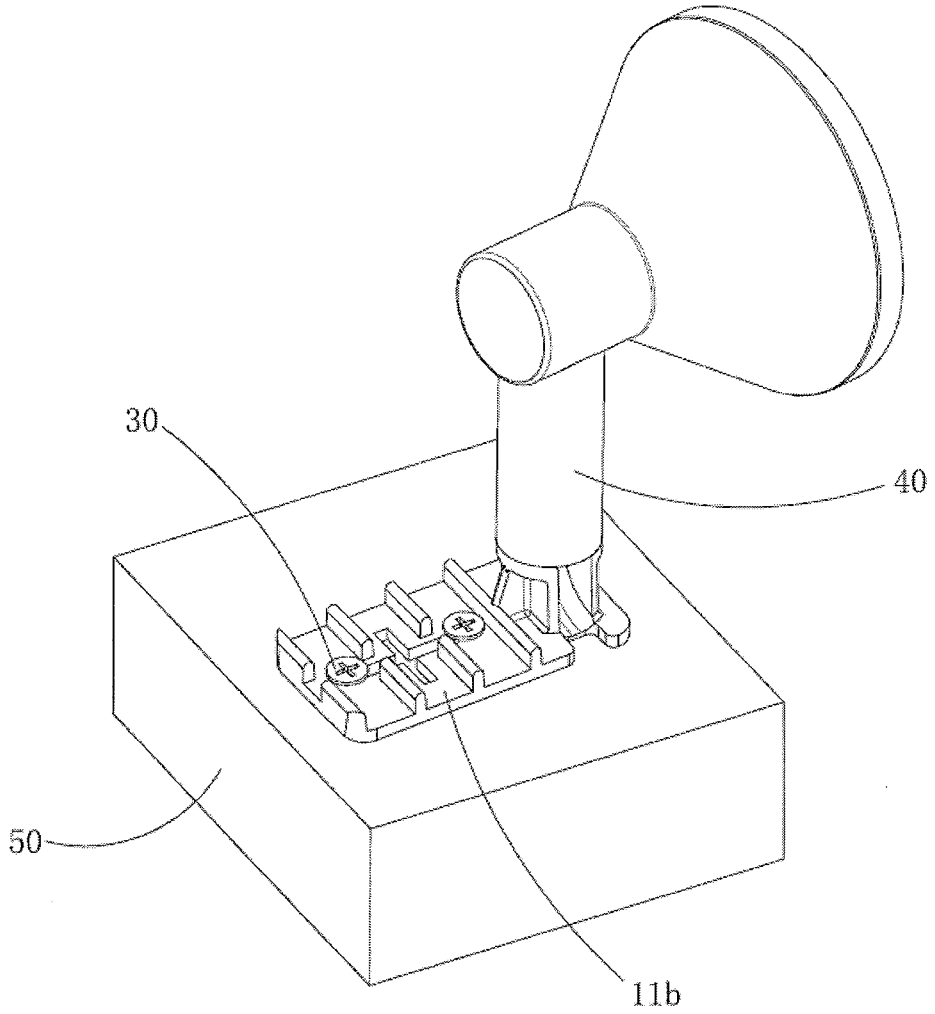
FIG. 12 is a perspective view showing the ground insert lamp being mounted on the wall.

Referring to FIGS. 6-8, the pedal 11*a* has a rectangular shape, and the connector 13*a* has an annular shape and is located at one side of the pedal 11*a*. The connector 13*a* is provided with a plurality of first slits 132. The pedal 11*a* is provided with a plurality of second slits 18 connected to the first slits 132 of the connector 13*a*. The connector 13*a* has a middle position provided with a passage 131. The first slits 132, the second slits 18 and the passage 131 construct the slot 14*a*, and the stake 20*a* is inserted through the slot 14*a*. The restriction member 23*a* is located at an edge of an upper end of the stake 20*a* and is locked on the upper face of the pedal 11*a*.

Referring to FIGS. 9-12, the pedal 11*b* has a rectangular shape, and the connector 13*b* has an annular shape and is located at one side of the pedal 11*b*. The pedal 11*b* is provided with a plurality of slots 14*b* arranged between the ribs 12*b*. The slots 14*b* are arranged in an intersecting manner and are connected to each other. The restriction member 23*b* of the stake 20*b* includes a plurality of restriction bars arranged in an intersecting manner. The stake 20*b* is inserted through the slots 14*b*, and the restriction member 23*b* of the stake 20*b* is locked between the ribs 12*b*. The restriction member 23*b* of the stake 20*b* has a bottom locked on the slots 14*b*.

Figure 13:
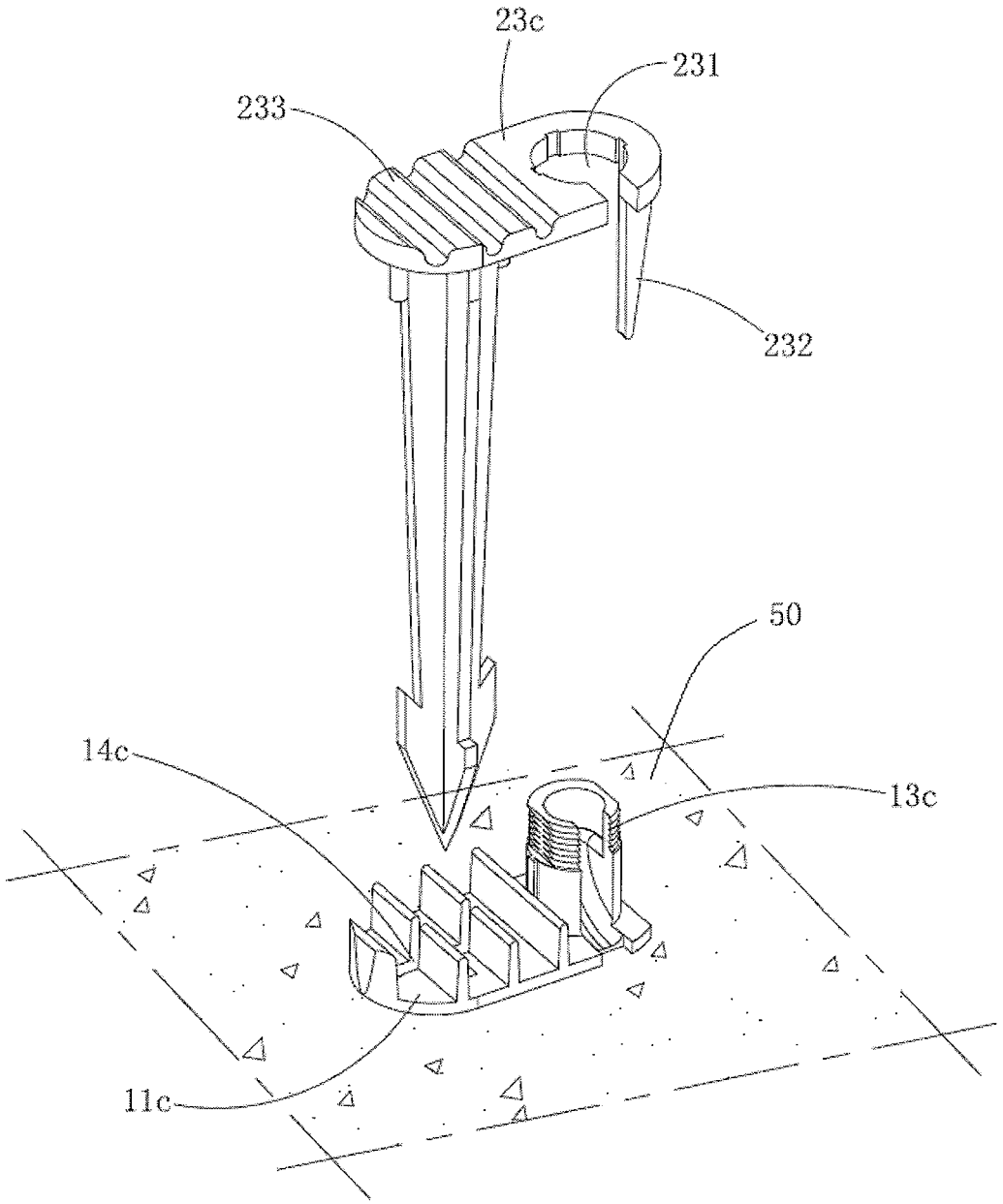
FIG. 13 is a partially exploded perspective assembly view of a ground insert lamp in accordance with the fourth preferred embodiment of the present invention.
Figure 14:
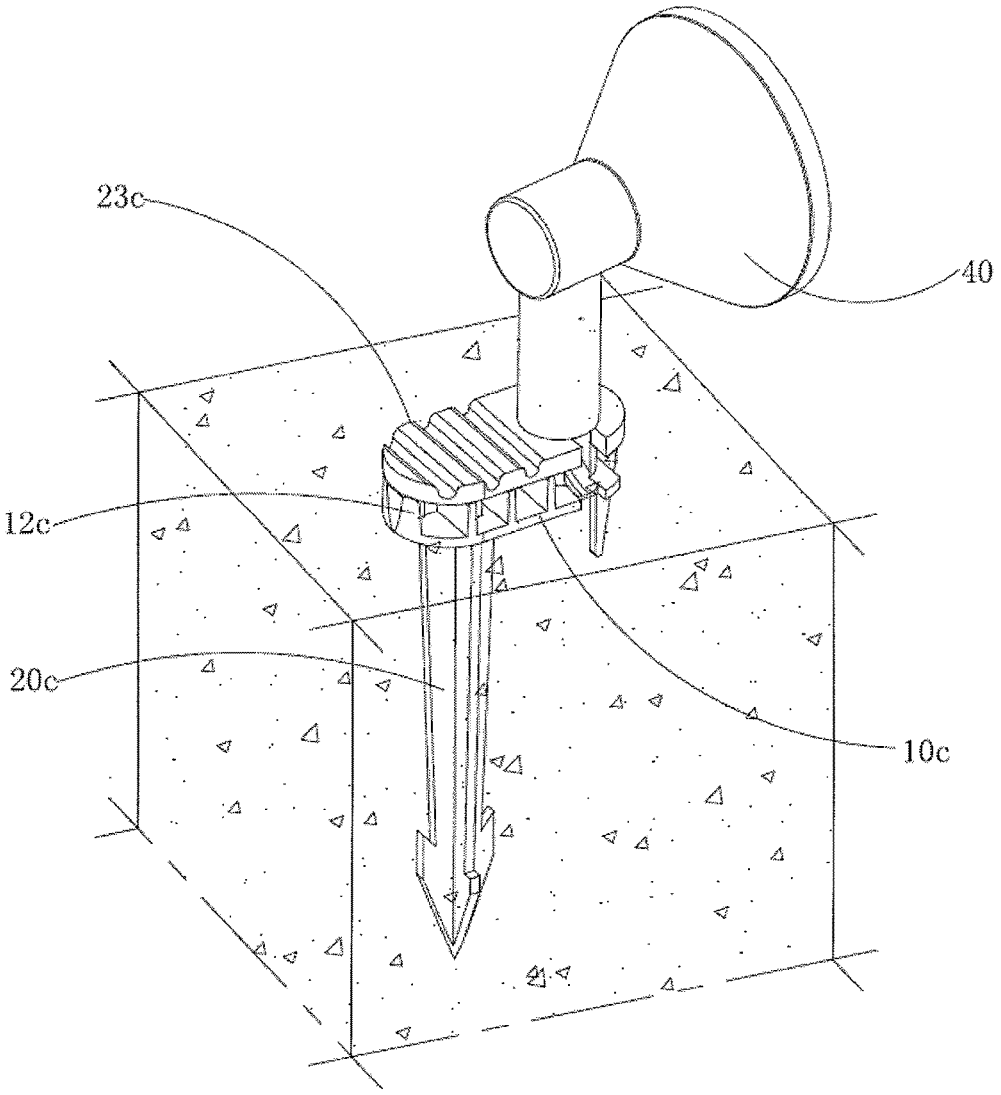
FIG. 14 is a perspective view showing the ground insert lamp being mounted on the ground.
Figure 15:
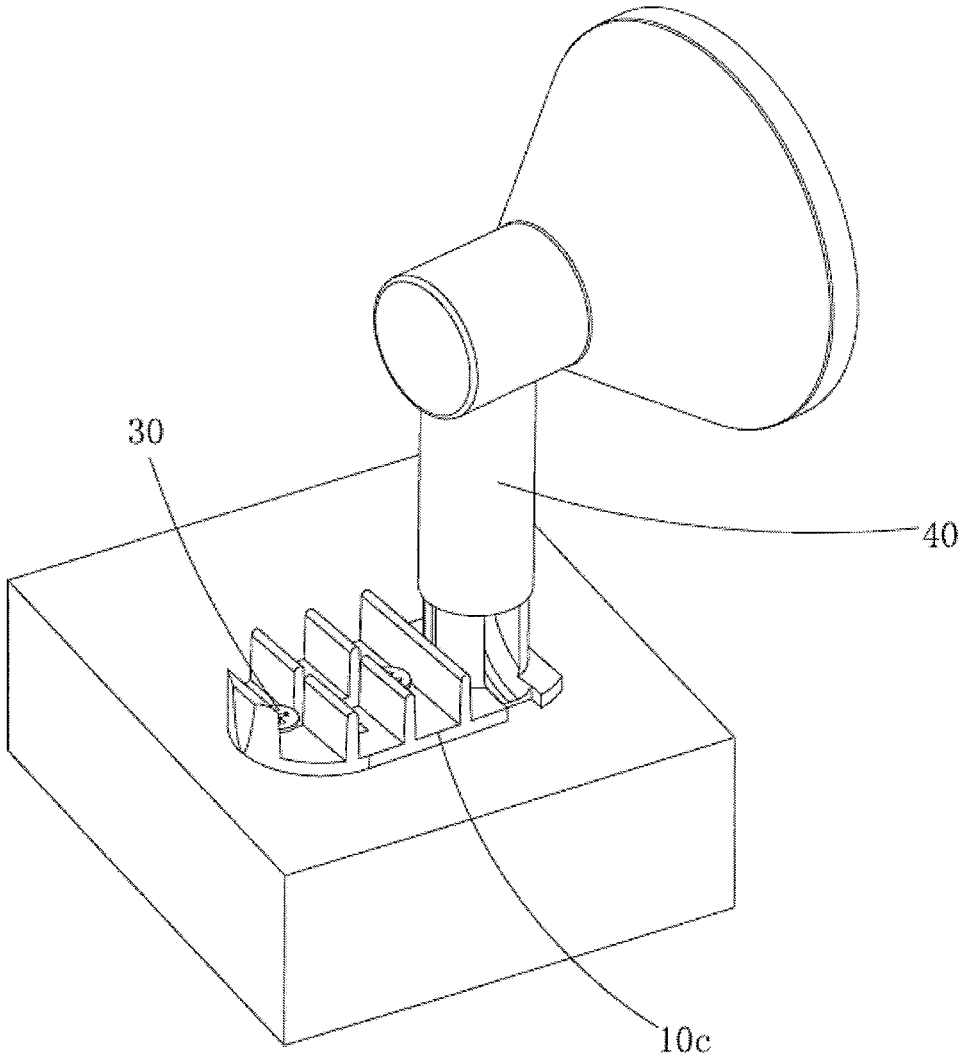
FIG. 15 is a perspective view showing the ground insert lamp being mounted on the wall.

Referring to FIGS. 13-15, the restriction member 23*c* of the stake 20*c* has an upper face provided with a plurality of protruding pieces 233 and a lower face provided with a prong 232. The restriction member 23*c* of the stake 20*c* is provided with a through hole 231. In assembly, the stake 20*c* is inserted through the slot 14*c*, the connector 13*c* of the fixed seat 10*c* is inserted through the through hole 231 and protrudes from the upper face of the restriction member 23*c*, the ribs 12*c* of the fixed seat 10*c* abut the lower face of the restriction member 23*c*, and the prong 232 of the restriction member 23*c* passes through the breach 16*c* of the connector 13*c* and is inserted into the ground 50.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the scope of the invention.

The invention claimed is:

1. A ground insert lamp comprising:

a fixed seat, a stake, a lamp body and a plurality of fasteners, wherein:

the fixed seat is affixed to a ground by the stake or affixed to a wall by the plurality of fasteners;

the fixed seat includes a pedal and a connector integrally formed on the pedal;

the connector has a periphery provided with a breach extending longitudinally;

the lamp body is removably mounted on the connector;

the pedal has a periphery provided with an opening extending inwardly and connected to the breach of the connector;

the pedal has an upper face provided with a plurality of ribs;

the pedal is provided with a slot corresponding to the stake and a plurality of fastening holes corresponding to the plurality of fasteners;

the stake includes an insert and a restriction member mounted on an upper end of the insert;

the insert includes a plurality of upright plates arranged in a radiating manner;

each of the plurality of upright plates has a bottom having a tapered shape, with a vertical distance between an outer edge of the bottom of each of the plurality of upright plates and a central axis of the insert increasing gradually from bottom to top;

the insert has a conic pointed bottom;

the stake further includes a connecting portion located between the insert and the restriction member;

the restriction member of the stake has a sheet shape;

the restriction member of the stake is inserted through the slot of the pedal and extends through the pedal from bottom to top; and each of the plurality of upright plates has a top resting on the bottom of the pedal.

2. The ground insert lamp of claim 1, wherein:

the restriction member of the stake and the slot of the pedal have a rectangular shape;

the plurality of ribs is divided into multiple pairs corresponding to and aligning with each other;

the slot of the pedal is arranged between four of the plurality of ribs, with two diagonal ribs of the four of the plurality of ribs extending into two sides of the slot, so that the four of the plurality of ribs surround the slot of the pedal and form a space which allows a oneway rotation of the restriction member of the stake; and the stake is rotatable relative to the pedal, with the restriction member of the stake being locked between two pairs of the plurality of ribs.

3. A ground insert lamp comprising:

a fixed seat, a stake, a lamp body and a plurality of fasteners, wherein:

the fixed seat is affixed to a ground by the stake or affixed to a wall by the plurality of fasteners;

the fixed seat includes a pedal and a connector integrally formed on the pedal;

the connector has a periphery provided with a breach extending longitudinally;

the lamp body is removably mounted on the connector;

the pedal has a periphery provided with an opening extending inwardly and connected to the breach of the connector;

the pedal has an upper face provided with a plurality of ribs;

the pedal is provided with a slot corresponding to the stake and a plurality of fastening holes corresponding to the plurality of fasteners;

the stake includes an insert and a restriction member mounted on an upper end of the insert;

the insert includes a plurality of upright plates arranged in a radiating manner;

each of the plurality of upright plates has a bottom having a tapered shape, with a vertical distance between an outer edge of the bottom of each of the plurality of upright plates and a central axis of the insert increasing gradually from bottom to top;

the insert has a conic pointed bottom;

the connector is located at one side of the pedal;

the connector is provided with a plurality of first slits;

the pedal is provided with a plurality of second slits connected to the plurality of first slits of the connector;

the connector has a middle position provided with a passage;

the plurality of first slits, the plurality of second slits and the passage construct the slot; and the stake is inserted through the slot.

4. The ground insert lamp of claim 3, wherein the restriction member is located at an edge of an upper end of the stake and is locked on the upper face of the pedal.

5. The ground insert lamp of claim 3, wherein:

the restriction member of the stake has a lower face provided with a prong;

the restriction member of the stake is provided with a through hole;

the connector of the fixed seat is inserted through the through hole and protrudes from an upper face of the restriction member;

the plurality of ribs of the fixed seat abut the lower face of the restriction member; and the prong of the restriction member passes through the breach of the connector and is inserted into the ground.

6. The ground insert lamp of claim 5, wherein the upper face of the restriction member is provided with a plurality of protruding pieces.

7. A ground insert lamp comprising:

a fixed seat, a stake, a lamp body and a plurality of fasteners, wherein:

the fixed seat is affixed to a ground by the stake or affixed to a wall by the plurality of fasteners;

the fixed seat includes a pedal and a connector integrally formed on the pedal;

the connector has a periphery provided with a breach extending longitudinally;

the lamp body is removably mounted on the connector;

the pedal has a periphery provided with an opening extending inwardly and connected to the breach of the connector;

the pedal has an upper face provided with a plurality of ribs;

the pedal is provided with a slot corresponding to the stake and a plurality of fastening holes corresponding to the plurality of fasteners;

the stake includes an insert and a restriction member mounted on an upper end of the insert;

the insert includes a plurality of upright plates arranged in a radiating manner;

each of the plurality of upright plates has a bottom having a tapered shape, with a vertical distance between an outer edge of the bottom of each of the plurality of upright plates and a central axis of the insert increasing gradually from bottom to top;

the insert has a conic pointed bottom;

the connector is located at one side of the pedal;

the pedal is provided with a plurality of slots arranged between the plurality of ribs;

the plurality of slots is arranged in an intersecting manner and are connected to each other;

the restriction member of the stake includes a plurality of restriction bars arranged in an intersecting manner;

the stake is inserted through the plurality of slots; and the restriction member of the stake has a bottom locked on the plurality of slots.

8. The ground insert lamp of claim 7, wherein the restriction member of the stake is locked between the ribs.

* * * * *